United States Patent [19]

Morrell et al.

[11] 4,249,777

[45] Feb. 10, 1981

[54] METHOD OF IN SITU MINING

[75] Inventors: Roger J. Morrell; William C. Larson, both of Bloomington; Robert D. Schmidt, Isanti, all of Minn.

[73] Assignee: The United States of America as represented by the Secretary of the Interior, Washington, D.C.

[21] Appl. No.: 60,101

[22] Filed: Jul. 24, 1979

[51] Int. Cl.[3] ..... E21B 43/28

[52] U.S. Cl. ..... 299/4; 166/50; 166/245

[58] Field of Search ..... 299/2, 4, 5; 166/50, 166/245

[56] References Cited

U.S. PATENT DOCUMENTS

| | | | |
|---|---|---|---|
| 1,816,260 | 7/1931 | Lee | 166/50 X |
| 2,966,346 | 12/1960 | Huitt et al. | 299/4 |
| 3,563,606 | 2/1971 | Sears | 299/2 |
| 4,160,481 | 7/1979 | Turk et al. | 166/50 X |

*Primary Examiner*—Ernest R. Purser
*Attorney, Agent, or Firm*—Thomas Zack; Donald A. Gardiner

[57] ABSTRACT

An improved method of in situ mining of a mineral bearing stratum. The method comprises drilling alternating rows of vertical injection and recovery wells to the depth of an aquiferrous mineral bearing stratum. Two horizontal branches are drilled at the bottom of each injection and recovery well. The horizontal branches are substantially parallel to one another and lie within the mineral bearing stratum. Leachant fluid is pumped under pressure into the injection wells to dissolve the minerals contained in the stratum. Leachant fluid containing the dissolved minerals is pumped out through the recovery wells. The method of the present invention requires substantially less drilling and pipe for extracting minerals from a given volume of a mineral bearing stratum and results in more constant mineral extraction rates than conventional techniques.

4 Claims, 2 Drawing Figures

METHOD OF IN SITU MINING

BACKGROUND OF THE INVENTION

The invention relates to the field of in situ mining, and more particularly to a method of in situ mining using plural alternating rows of injection and recovery wells.

In situ mining has been recognized as an effective technique for recovery of minerals contained in an ore or mineral bearing stratum. Prior techniques for in situ mining have utilized one or more vertical injection wells drilled to the depth of an aquiferrous mineral bearing stratum for injecting a chemical leachant into the stratum to dissolve the desired minerals. In the prior art, a plurality of vertical injection wells, generally greater in number than the number of recovery wells, are arranged about each recovery well to pump out the leachant containing the dissolved minerals. The wells are arranged in what are known as "five-spot," "seven-spot," and "hexagonal" patterns with one recovery well surrounded by a number of injection wells.

Each vertical injection and recovery well generally includes a vertical screen disposed at the depth of the mineral bearing stratum to allow ready flow of the leachant fluid into and out of the recovery and injection wells.

A chief disadvantage of such conventional in situ mining techniques is that a large number of wells must be drilled to adequately cover a given volume of an aquiferrous mineral bearing stratum because each recovery well requires a plurality of associated injection wells. The cost of drilling, pipes, and pumping devices is proportionally multiplied when larger ore fields are mined. The high cost of drilling and mining marginal ore fields makes such mining economically impractical.

Conventional injection/recovery well patterns characteristically produce a declining volume of dissolved minerals recovered over the lifetime of the mining operation because toward the end of the operation, most of the minerals in the area directly between the recovery well and surrounding injection wells have already been leached. Pumping speed, and hence recovery volume, using conventional well patterns is low since one recovery well receives leachant under pressure from several injection wells.

Vertically oriented injection/recovery screens, as used in conventional in situ mining techniques, must be precisely placed within the ore-bearing stratum in order to insure maximum extraction of the ore-bearing layer (i.e., greatest injection/recovery well efficiency). However, placement of vertical well holes, especially in shallow formations at great depths (approximately 1,000 feet or more), can be difficult and time-consuming. In addition, vertically oriented injection/recovery screens do not "sweep out" a large area of the ore-bearing stratum since the stratum is generally horizontally aligned, whereas the screens are vertically aligned.

It is known to use horizontally well-branches or "drain-holes" to drain off undesirable aquifer (water-containing) regions which interfere with oil well drilling and oil recovery. However, heretofore such horizontal well branches have not been used for in situ mining of a mineral bearing stratum using a leachant fluid and plural injection and recovery wells.

It is therefore a primary object of the invention to provide an improved method of in situ mining of a mineral bearing stratum.

It is an additional object to provide an improved method of in situ mining utilizing horizontal branches which method requires substantially less drilling and pipe to recover a given volume of ore-bearing material than conventional in situ mining techniques.

It is a further object to provide a method of in situ mining having a substantially constant rate of mineral recovery over the lifetime of the mining operation.

SUMMARY OF THE INVENTION

These and other objects of the invention are achieved by the present invention wherein there is provided an improved method of in situ mining of a mineral bearing stratum. The method comprises the steps of drilling alternating rows of vertical injection and recovery wells, each such row containing a plurality of wells. The injection and recovery wells are drilled to the depth of an aquiferrous mineral bearing stratum. At least two horizontal branches are drilled out from the bottom of each vertical well in approximately the middle of the ore-bearing stratum. The horizontal branches of each well are aligned substantially parallel to one another. Each branch includes an aquifer oriented screen to allow ready injection or recovery of leachant fluid.

Leachant fluid is pumped under pressure into the injection wells to dissolve the minerals contained in the stratum. Leachant fluid containing the dissolved minerals is pumped out through the recovery wells.

Preferably, the number of injection well rows is equal to the number of recovery well rows, and the number of injection wells in a single row is equal to the number of recovery wells in an adjacent row.

The method of the present invention requires substantially fewer wells and much less pipe (up to one-tenth to extract minerals from a given volume of a mineral bearing stratum than conventional single recovery well-plural injection well arrangements. The costs of mining are reduced, thus allowing formerly uneconomic or marginal ore deposits to be recovered.

The use of horizontal well branches having aquifer oriented screens results in a larger volume of the ore-bearing stratum being swept out for each injection/-recovery well pair. As mentioned above, the total number of injection wells is equal to the total number of recovery wells. This, in combination with the alternating row arrangement of injection recovery wells, results in a desirably high volume flow of leachant fluid throughout the ore-bearing layer since there is a one-to-one correspondence between injection and recovery wells. Thus, the rate of mineral extraction is high and is accomplished at a constant rate.

The use of horizontal branch wells also results in wider tolerance for vertical well drilling depth errors since the depth of the horizontal branches can be adjusted if it is found that the bottom of the verical portion of the well has not been precisely placed in the middle of the ore-bearing stratum.

BRIEF DESCRIPTION OF THE DRAWING FIGURES

These and other features, objects, and advantages of the present invention are presented in the following description of the preferred embodiment, taken in conjunction with the accompanying drawing figures, wherein:

FIG. 1 is a schematic perspective view showing an arrangement of injection and recovery wells as taught by the method of the present invention; and FIG. 2 is a cross-sectional view of a single injection or recovery well of FIG. 1.

DETAILED DESCRIPTION OF THE PREFERRED EMBODIMENT

Figure 2:
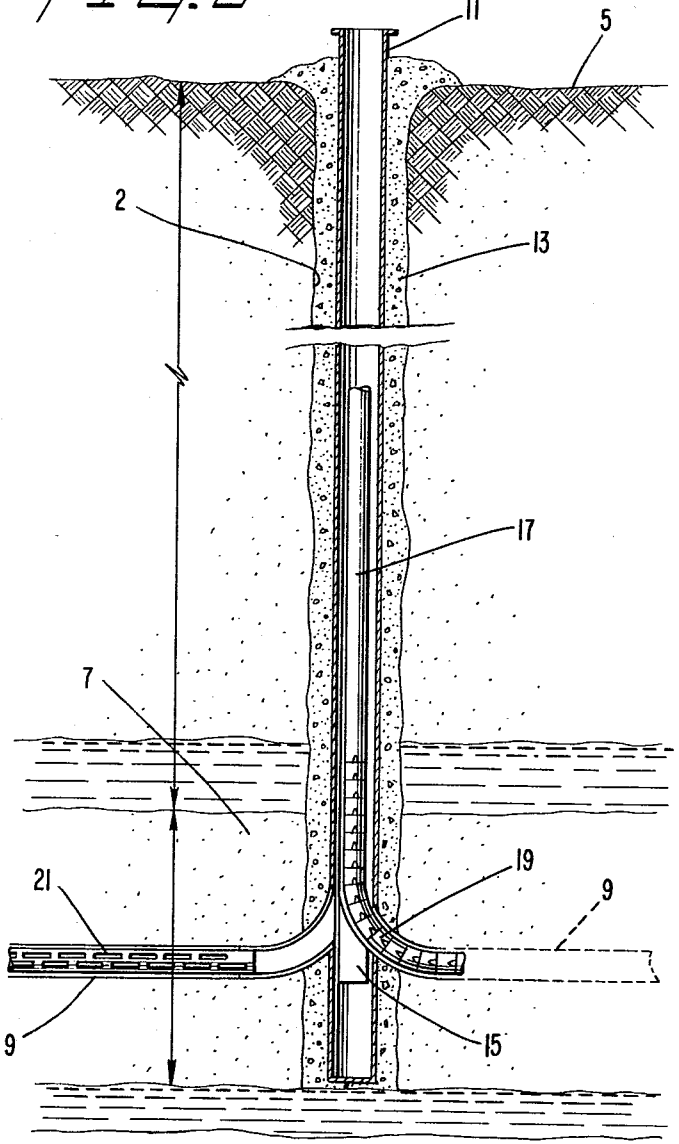
Figure 1:
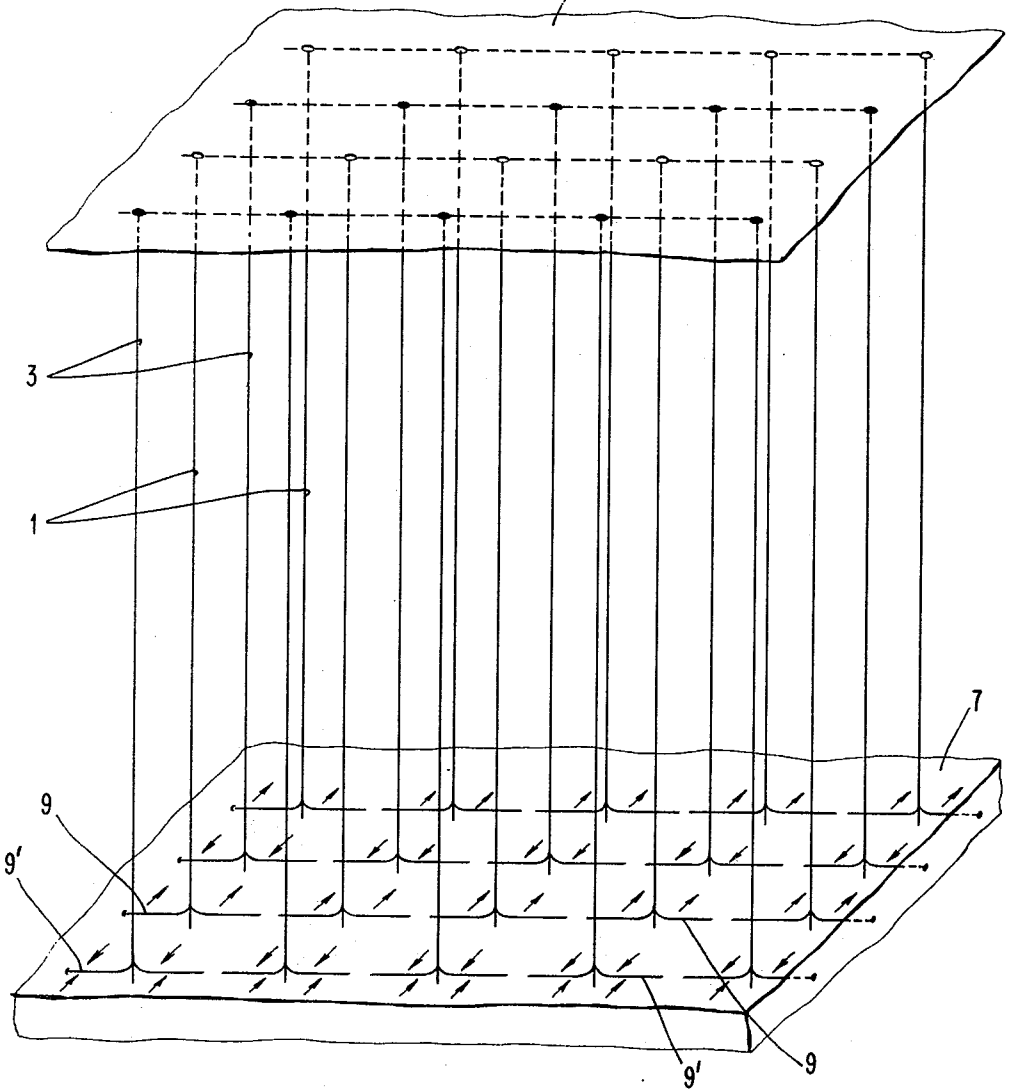

The method of the present invention is described in conjunction with drawing FIGS. 1 and 2. Alternating rows of vertical injection wells 1 and vertical recovery wells 3 are drilled or otherwise formed from surface 5 to the depth of a mineral bearing ore zone or stratum 7. The alternating rows of injection and recovery wells are arranged in a matrix or grid-like pattern as shown in FIG. 1.

Each injection well row and recovery well row contains a plurality of individual wells, with the number of wells of an injection row preferably equal in number to the number of recovery wells in an adjacent row. In other words, at least one injection well and at least one recovery well are contained in each row. Therefore, in its simplest preferred form a recovery field may be a single line of alternating injection and recovery wells.

At substantially the lowest portion of each injection and recovery well at least one substantially horizontal well branch 9 and 9′, respectively, is formed. Preferably two such horizontal branches 9 and 9′ are formed from each respective injection and recovery well. Horizontal well branches 9 and 9′ are disposed substantially parallel to one another and lie within a plane defined by aquiferrous mineral bearing stratum 7.

Horizontal well branches 9 are formed as shown in FIG. 2. The well branch drilling operation is described with respect to the formation of an injection well 1. It is understood that an identical technique is used to form horizontal branches 9′ for recovery wells 3.

The vertical injection well is first drilled or formed by techniques well-known in the art. Injection well bore 2 is drilled to the depth of mineral bearing stratum 7. A well casing 11 is inserted into well bore 2 to the depth of stratum 7 and cement 13 poured around casing 11 to secure the casing within well bore 2.

A removable whipstock 15 is inserted near the base of well bore 2 and locked into a position approximately midway in depth within mineral bearing stratum 7.

Horizontal well branches 9 are formed using what is known as a "drain-hole" drilling technique. A drill pipe string 17, having a flexible U-joint spiral reamer 19 attached to the lower end thereof, is lowered into well bore 2 until reamer 19 contacts whipstock 15. Whipstock 15 causes reamer 19 to bend outwardly at approximately right angles to well bore 2. As reamer 19 advances, it forms a horizontal well branch 9.

Reamer 19 includes a conventional spiral stablizer having a tri-cone bit mounted on the end thereof. The exact design of the stabilizer and flexible drill pipe can vary.

When a first well branch 9 is drilled to the desired horizontal length, drill pipe 17 and reamer 19 are withdrawn and whipstock 15 rotated, so that a second horizontal well branch can be drilled. Up to three such horizontal well branches can efficiently be formed from a single vertical well bore.

Branches 9 can be cased or left uncased after drilling, as desired. Aquifer oriented (horizontal) screens 21 are placed in horizontal branches 9 to prevent sediment and unwanted particulate matter from flowing into the horizontal branches.

After completion of all vertical well and horizontal branch drilling operations, a leachant fluid 23, shown as flow lines in FIG. 1, is pumped under pressure into each injection well. The particular leachant fluid employed varies depending on the minerals to be dissolved and recovered from mineral-bearing stratum 7.

Leachant fluid 23 flows under pressure from injection well horizontal branches 9 toward adjacent recovery well horizontal branches 9′ (FIG. 1). The leachant fluid dissolves selected minerals contained in stratum 7. The flow of leachant fluid 23 from injection wells 1 to recovery wells 3 is generally within the plane defined by stratum 7.

Dissolved minerals from stratum 7 and leachant fluid are extracted through horizontal recovery well branches 9′. The leachant fluid containing the dissolved minerals is pumped out or otherwise extracted from recovery wells 3 to the surface. The dissolved minerals are separated from the leachant fluid in subsequent recovery steps.

The spacing between wells in a row is dependent on the length of the well branches. For conventional drilling techniques, a maximum well branch length of approximately 150 feet (of 2″ to 6″ diameter pipe) is possible, thus giving an appropriate spacing between wells in a row of more than 300 feet. The distance between rows is determined by the flow characteristics of the leachant fluid.

In an alternate arrangement, vertical injection and recovery wells 1 and 3 are respectively drilled to the depth of the upper and lower boundaries of mineral bearing stratum 7. Horizontal branches 9 and 9′ are formed as described above. Leachant fluid is pumped into the stratum through injection wells 1 and flows substantially vertically through stratum 7 to recovery wells 3. This arrangement is advantageous for in situ mining where the mineral bearing stratum is narrow in the horizontal dimension but is vertically deep.

In the present invention, the horizontal orientation of the injection and recovery well branch screens 21 parallel to the plane of the aquiferrous mineral-bearing stratum provides several advantages over conventional in situ mining methods which use vertical screen injection and recovery. Sweep efficiency is improved since leachant fluid flows through substantially all the volume of the mineral bearing stratum which lies between the horizontal branches of an injection well and the horizontal branches of a recovery well. Fluid injection recovery capacity is increased because there is generally a one-to-one correspondence between the number of injection wells and adjacent recovery wells. This reduces the time required to leach minerals from a given volume of a mineral bearing stratum. Leachant dispersion is more uniform because of the adjacent nature of parallel injection well rows and recovery well rows. This results in a more uniform recovery rate over the lifetime of the mining operation. The in situ mining method of the present invention also gives greater control over the movement of the leachant fluid, thus reducing the possibility of leachant escape and environmental pollution.

In simulated tests, the method of the present invention may be compared to conventional "five-spot" in situ mining techniques. In the "five-spot" in situ mining technique, and analogous arrangements, a single recovery well is placed at the center of a number of leachant injection wells. In the case of the "five-spot" arrangement, four vertical injection wells are drilled in an equal spaced arrangement about a central vertical recovery well. Each vertical injection and recovery well is drilled to the depth of a mineral bearing stratum. The injection and recovery wells each include vertically oriented screens disposed within the well bores with the length of the screens approximately equal to the thickness of the mineral bearing stratum.

Sweep efficienty of a particular in situ mining technique is determined by taking the ratio of the actual volume of a mineral bearing stratum through which injected leachant fluid flows to the total volume of the mineral bearing stratum to be mined.

In a standard volume of 100×100 horizontal feet by 20 vertical feet (200,000 cubic feet), a "five-spot" injection/recovery arrangement in which the mineral bearing stratum is bounded at the four corners by the injection wells, simulated tests show that the two-dimensional area swept out by leachant fluid is approximately 6,000 square feet. With a stratum thickness of 20 feet, this gives a volume swept out of 120,000 cubic feet. The sweep efficiency therefore is 120,000/200,000 or 60%.

For the same volume of an ore-bearing stratum (200,000 cubic feet), the horizontal injection/recovery technique of the present invention results in a higher sweep efficiency. Rows of vertical injection and recovery wells are spaced approximately 50 feet apart. Each vertical well includes horizontal branches approximately 100 feet long (total for both branches) disposed parallel to one another in the plane of the mineral-bearing stratum. The area swept out by leachant fluid between the horizontal injection and recovery well branches in simulated tests, as defined by the 20 foot difference between the upper and lower boundaries of the mineral bearing stratum, is approximately 1418 square feet. Multiplying this figure by the 100 feet of horizontal screen results in a figure for the volume swept of 141,800 cubic feet. Thus, the sweep efficiency for the method of the present invention is 71%. In both test simulations, the porosity and permeability of the aquiferrous stratum are assumed to be the same.

The greater efficiency of the method of the present invention over conventional "five-spot" and analogous arrangements results from the more complete saturation of the volume of the ore tone between adjacent rows of injection and recovery well horizontal branches. Unlike the "five-spot" pattern, in which leachant fluid flow lines are concentrated mainly within the areas directly between the outer injection wells and the central recovery well, the present invention provides for leachant fluid injection and recovery across substantially the entire width of a volume of mineral bearing stratum to be mined.

It is essential in in situ mining operations that the rate of leachant fluid injection and recovery be equal, to prevent leachant from escaping into and polluting the surrounding mineral bearing stratum. Fluid flow rates are limited in the "five-spot" arrangement by the fact that the ratio of vertical recovery screen to vertical injection screen length is always 1:4. Thus, the injection capacity of a typical "five-spot" or analogous well arrangement is limited by its recovery capacity. Typical fluid flow rates for recovery wells are approximately one gallon per minute per screen foot (one gal./min/ft. screen). This implies that the injection well fluid flow capacity for such prior art arrangement is limited to approximately one-quarter gallon per minute per screen foot (¼ gal./min/ft. screen).

In contrast, with horizontally oriented aquifer screens as used in the present invention, the ratio of recovery screen length to injection screen length can be up to 1:1. Thus, for a recovery of one gallon per minute per screen foot, the injection rate is as high as one gallon per minute per screen foot using the methods of the present invention.

The higher injection rates of the present invention, coupled with the greater sweep efficiency, result in overall increased fluid injection and recovery capacity over prior art in situ mining techniques.

Fluid injection/recovery capacity is measured in terms of pore volumes, where one pore volume is equal to that portion of a fixed volume of aquiferrous mineral bearing stratum which constitutes open space. For the examples given above, the fixed volume is a 100′×100′×20′ block of material. Assuming a porosity of approximately 35%, this results in one pore volume being equal to approximately 70,000 cubic feet.

In the simulated tests mentioned above, assuming 30 days of simulated pumping with the conventional "five-spot" pattern, 6.1 pore volumes of leachant are injected at the four corner wells with 0.77 pore volume (approximately 12%) of leachant recovered at the center recovery well. Therefore, approximately 88% of the leachant remained in the mineral bearing stratum after 30 days.

Using the methods of the present invention, approximately 36 pore volumes of leachant are injected into an identical 100′×100′×20′ volume of mineral bearing materials during 30 days of pumping, and 17.7 pore volumes (aproximately 49.7%) of the leachant fluid are recovered through the recovery wells after 30 days.

An important advantage of the horizontally aligned injection and recovery well screens of the present invention over conventional vertically oriented injection and recovery well screens is that a more uniform dispersion of leachant fluid is produced within the volume swept out by the leachant. This results in a more uniform mineral recovery rate over the lifetime of the mining operation. Fluid flow from all portions of the horizontal screens placed in the horizontal branches formed according to the present invention is substantially uniform. Leachant also tends to be most concentrated in the volume swept out between adjacent injection and recovery well rows. The higher concentration of leachant results in a more effective leaching process.

Leachant fluid flow and leachant pollution of surrounding areas of the mineral bearing stratum are also readily controlled by the method of the present invention.

In conventional "five-spot" arrangements having vertically oriented injection and recovery screens, leachant fluid stream lines radiate in all directions from each injection well. Since the injection wells are disposed about the central recovery well, some of the radial injection well stream lines escape the influence of the center recovery well. Thus, recovery of all the escaping leachant fluid is a difficult process. At least four intercept or "guard" wells are required around a conventional "five-spot" pattern to prevent leachant fluid escape.

In contrast, leachant flow between the parallel, horizontally aligned well branches of the present invention is concentrated in a substantially narrow area between the injection well branches and the recovery well branches. The injection and recovery wells can be arranged so that the outermost row of an array of such wells is a recovery well row. Thus, the outer recovery well rows intercept all of the leachant fluid not captured by the recovery wells disposed near the center of the well pattern. Another advantage of this arrangement is that if further areas of a mineral bearing stratum are to be mined, these outermost recovery well rows can later be used to leach adjacent blocks of the mineral bearing stratum.

Another advantage of the method of the present invention is that it requires only approximately one-tenth the total amount of drilling, pipe, and casing compared to conventional drilling patterns, for the same volume coverage. In extending a mining area by 2,500 square feet, a conventional "five-spot" pattern requires three new wells, assuming a normal well spacing of approximately 50 feet. If the depth to the mineral bearing stratum is approximately 500 feet deep, this extended drilling requires $3\times500'=1{,}500$ feet of new drilling, pipe and casing. This conventional setup also requires three additional drilling rigs and the shutting down of three injection wells on the side of the well field opposite the side which is being extended.

Using the techniques of the method of the present invention, only one vertical well and associated pair of horizontal branch wells are needed to extend the leaching area of the mineral bearing stratum by 15,000 square feet. Assuming a length for each horizontal branch of 150 feet and a normal spacing between rows of wells of 50 feet, the total footage required for drilling is 500 vertical feet plus 300 horizontal feet for a total of 800 feet.

Using the figures given above, extending the conventional "five-spot" pattern 15,000 square feet requires 15,000/2,500 or six sets of three wells each (i.e., 18 new wells). For a drilling depth of 500 feet, this means a total footage of $18\times500'$ or 9,000 total feet is required. This amount of drilling footage is approximately 11 times greater than that required by the method of the present invention to extend the leaching area by the same amount. In addition, since every third well in the conventional "five-spot" pattern must be a recovery well, each such recovery well requires a pump. Thus, six out of the eighteen additional wells which are drilled in the "five-spot" pattern example given above would require pumps versus only one additional pump needed by the method of the present invention.

Thus, the present invention provides improved sweep efficiencies and desirable high volume flow of leachant fluid throughout a mineral bearing stratum. The rate of mineral extraction is high and is accomplished at a constant rate. The use of horizontal branch wells results in a wider tolerance for vertical well drilling depth errors since the depth of the horizontal branches can be adjusted. Leachant fluid flow is precisely controlled using the techniques of the present invention to prevent leachant escape and environmental pollution of areas surrounding a mineral bearing stratum.

While the in situ mining method of the present invention has been described in considerable detail, it is understood that various changes and modifications would occur to persons of ordinary skill in the art without departing from the spirit and scope of the appended claims.

What is claimed is:

1. A method of in situ leach mining of a mineral bearing stratum comprising the steps of:

surface drilling a plurality of generally vertical leachant injection wells, said injection wells being horizontally spaced apart and aligned in a row;

surface drilling a plurality of generally vertical recovery wells, said recovery wells being horizontally spaced apart and aligned in a row substantially parallel to said injection wells, said injection and recovery wells each being drilled to a depth substantially equal to the depth of an aquiferrous mineral bearing stratum;

surface drilling at least two generally horizontal branch wells from substantially the lowest point of each of said injection and recovery wells, said horizontal branches being parallel to one another and lying within a plane containing said stratum of minerals to be recovered each said branch including a screened section;

pumping a leachant fluid under pressure into said injection wells to dissolve minerals contained in said mineral stratum; and pumping said leachant containing said dissolved minerals out through said recovery wells, whereby said leached minerals are withdrawn from said mineral bearing stratum at a substantially constant rate over the lifetime of the mining operation.

2. The method of claim 1 wherein there are a plurality of alternating rows of said injection and recovery wells, with the number of parallel disposed injection and recovery well rows being equal in number.

3. The method of claim 2 wherein the number of injection wells in a row is equal to the number of recovery wells in an adjacent row.

4. The method of claim 1 wherein said injection and recovery wells are drilled to a depth substantially equal to the upper and lower boundaries of the mineral bearing stratum.

* * * * *